US012781730B2

(12) United States Patent
Liu

(10) Patent No.: US 12,781,730 B2
(45) Date of Patent: Nov. 3, 2026

(54) INFLATION PUMP

(71) Applicant: Jingcong Liu, Heyuan (CN)

(72) Inventor: Jingcong Liu, Heyuan (CN)

( * ) Notice: Subject to any disclaimer, the term of this patent is extended or adjusted under 35 U.S.C. 154(b) by 91 days.

(21) Appl. No.: 18/950,784

(22) Filed: Nov. 18, 2024

(65) Prior Publication Data

US 2026/0132779 A1 May 14, 2026

(30) Foreign Application Priority Data

Nov. 8, 2024 (CN) ..... 202422732806.1

(51) Int. Cl.

| | |
|---|---|
| ***F04B 49/06*** | (2006.01) |
| ***F04B 35/04*** | (2006.01) |
| ***F04B 49/08*** | (2006.01) |
| ***F04B 49/20*** | (2006.01) |

(52) U.S. Cl.

CPC ..... *F04B 49/06* (2013.01); *F04B 35/04* (2013.01); *F04B 49/08* (2013.01); *F04B 49/20* (2013.01); *F04B 2203/0208* (2013.01); *F04B 2203/0209* (2013.01)

(58) Field of Classification Search

CPC ..... F04B 49/06; F04B 35/04; F04B 49/08; F04B 49/20; F04B 2203/0208; F04B 2203/0209

See application file for complete search history.

(56) References Cited

U.S. PATENT DOCUMENTS

| | | | | |
|---|---|---|---|---|
| 6,705,360 | B1 * | 3/2004 | Bonzer | B60S 5/046 417/313 |
| 7,556,478 | B2 * | 7/2009 | Klein | F04B 35/04 417/44.1 |
| 8,925,594 | B2 * | 1/2015 | Ohm | F04B 35/04 141/94 |
| 9,860,361 | B1 * | 1/2018 | Hall | H04W 4/80 |
| 10,030,647 | B2 * | 7/2018 | Ortiz | F04B 53/16 |
| 10,830,229 | B1 * | 11/2020 | Lurker | F04B 35/04 |
| 10,974,701 | B2 * | 4/2021 | McIntyre | F04B 35/04 |

(Continued)

FOREIGN PATENT DOCUMENTS

| | | | |
|---|---|---|---|
| CN | 201320312 Y | * | 10/2009 |
| CN | 207406453 U | * | 5/2018 |

(Continued)

*Primary Examiner* — Matthew T Largi

(57) ABSTRACT

An inflation pump includes a main body, a control module, a pump body, a battery, a stepless adjustment member, and a selector switch. The control module, the pump body, the battery, the stepless adjustment member, and the selector switch are arranged on the main body. The control module is electrically connected to the battery, the pump body, the stepless adjustment member, and the selector switch, respectively. A plurality of inflation types with different power ranges for driving the pump body to work are preset within the control module. The selector switch is used for user operation and transmitting a switching signal to the control module. The stepless adjustment member is used for user operation and transmitting a stepless adjustment signal to the control module. The control module switches an inflation type according to the switching signal and outputs preset power corresponding to the inflation type to the pump body.

18 Claims, 7 Drawing Sheets

(56) References Cited

U.S. PATENT DOCUMENTS

| | | | | |
|---|---|---|---|---|
| 2007/0237652 | A1* | 10/2007 | Belanger | B60C 23/0479 417/279 |
| 2007/0275615 | A1* | 11/2007 | Norton | F04B 49/022 441/90 |
| 2008/0277044 | A1* | 11/2008 | Marini | F04B 35/06 417/313 |
| 2019/0211829 | A1* | 7/2019 | Huang | F04D 25/166 |
| 2024/0035461 | A1* | 2/2024 | Liao | F04B 37/12 |
| 2024/0221437 | A1* | 7/2024 | Knott | G07C 5/008 |

FOREIGN PATENT DOCUMENTS

| | | | |
|---|---|---|---|
| CN | 211131010 | U * | 7/2020 |
| CN | 217712858 | U * | 11/2022 |

* cited by examiner

INFLATION PUMP

CROSS-REFERENCE TO RELATED APPLICATIONS

The application claims priority of Chinese patent application CN2024227328061, filed on Nov. 8, 2024, which is incorporated herein by reference in its entireties.

TECHNICAL FIELD

The present invention relates to the technical field of pumps, particularly to an inflation pump.

BACKGROUND ART

An inflation pump is a device used for inflating car tires, bicycle tires, and electric vehicle tires. For the convenience of carrying and using outside, an in-vehicle wireless inflation pump has appeared on the market. The inflation pump includes a housing, a battery, a circuit board, and a pump body. The battery, the circuit board, and the pump body are arranged inside the housing. An air outlet hole of the pump body is connected to an inflation tube, and the inflation tube is used for adapting to a tire for inflation, so that the tire can be inflated in a timely manner when it is flat. However, currently, an existing in-vehicle wireless inflation pump can only output one type of air pressure, which is only suitable for use in one type of car. The air pressure outputted cannot be adjusted, that is, it is suitable for inflating car tires but not for inflating bicycle tires. The applicability is extremely limited, and the diverse needs of users for inflation air pressure cannot be met.

SUMMARY

The main purpose of the present invention is to provide an inflation pump for solving the problem that an existing inflation pump only output one type of air pressure and cannot meet diverse needs of a user for inflation air pressure.

In order to solve the above technical problem, a technical solution provided in the present invention is as follows.

An inflation pump includes a main body, a control module, a pump body, a battery, a stepless adjustment member, and a selector switch. The control module, the pump body, the battery, the stepless adjustment member, and the selector switch are arranged on the main body. The control module is electrically connected to the battery, the pump body, the stepless adjustment member, and the selector switch, respectively.

A plurality of inflation types with different power ranges for driving the pump body to work are preset within the control module. The selector switch is used for user operation and transmitting a switching signal to the control module, and the stepless adjustment member is used for user operation and transmitting a stepless adjustment signal to the control module.

The control module is configured for switching an inflation type according to the switching signal and outputting preset power corresponding to the inflation type to the pump body. The control module is also configured for adjusting driving power output to the pump body within a power range of a corresponding inflation type according to the stepless adjustment signal.

Furthermore, the stepless adjustment member is a digital encoder or a rotary potentiometer.

Furthermore, the main body is equipped with a roller. The roller is connected to the stepless adjustment member. The stepless adjustment member is configured for outputting a stepless adjustment signal to the control module when the user rotates the roller.

Furthermore, the stepless adjustment member is a sliding potentiometer. The sliding potentiometer is configured for outputting the stepless adjustment signal to the control module when the user operates.

Furthermore, the control module includes a microcontroller unit (MCU) and a power adjustment unit. The selector switch, the stepless adjustment member, the battery, and the power adjustment unit are all electrically connected to the MCU. The power adjustment unit is electrically connected to the pump body. The plurality of inflation types are provided in the MCU. The MCU is used for receiving the stepless adjustment signal and generating a driving signal corresponding to the stepless adjustment signal. The power adjustment unit is used for receiving the driving signal and adjusting the driving power output to the pump body.

Furthermore, the power adjustment unit includes a switch tube. A drain electrode of the switch tube is electrically connected to a negative electrode of the pump body, a source electrode of the switch tube is grounded, a grid electrode of the switch tube is electrically connected to the MCU, and a positive electrode of the battery is electrically connected to a positive electrode of the pump body. The switch tube conducts according to the driving signal output by the MCU and adjusts duty ratio according to the driving signal to regulate the driving power output to the pump body.

Furthermore, the inflation pump further includes a pressure sensor arranged on the main body. The pressure sensor is positioned at an output end of the pump body. The pressure sensor is electrically connected to the control module. The pressure sensor is used for detecting an air pressure output by the main body and feeding back a pressure signal corresponding to the air pressure to the control module. The control module adjusts the driving power output to the pump body based on the pressure signal.

Furthermore, the inflation pump further includes a display arranged on the main body. The display is used for at least one of displaying the output air pressure and displaying electrical quantity of the battery.

Furthermore, the inflation pump further includes a lighting module for illumination. The lighting module is arranged on the main body, and the control module is electrically connected to the lighting module.

Furthermore, the lighting module includes a lamp board arranged inside the main body and a lighting lamp arranged on the lamp board. The lamp board is electrically connected to the control module, and the lamp board is positioned at a top portion of the pump body. A top portion of the main body is provided with a lighting opening at a position corresponding to the lighting lamp. The main body is provided with a lampshade at a position corresponding to the lighting opening. The top portion of the main body is provided with an air outlet interface for connecting to an inflation tube. The air outlet interface is in communication with an air outlet of the pump body. The air outlet interface is positioned on one side of the lighting opening.

Furthermore, the main body is provided with a plurality of air inlet holes on a periphery of the lampshade, and the air outlet interface is positioned on one side of the air inlet holes away from the lighting opening.

Furthermore, the inflation pump further includes a lighting switch, and the control module drives the lighting module to illuminate when the lighting switch is operated.

Furthermore, the main body is equipped with a charging interface for connecting to an external power supply. The charging interface is electrically connected to the control module.

Furthermore, the inflation pump further includes a circuit board. The control module, the stepless adjustment member, and the selector switch are all integrated on the circuit board. The circuit board is provided inside the main body.

Furthermore, the main body includes a middle housing and an outer cover. A first cavity and a second cavity are defined in the middle housing. The pump body is arranged in the first cavity, and the battery is arranged in the second cavity. The outer cover is sleeved on an outer side of the middle housing, and a third cavity is formed between the outer cover and the middle housing. The circuit board is arranged in the third cavity. The third cavity is respectively connected to the first cavity and the second cavity.

Furthermore, the inflation pump further includes a roller. The stepless adjustment member is a digital encoder. Shaft rods are provided on both sides of the roller, and one of the shaft rods is connected to the digital encoder. The stepless adjustment member and the selector switch are both positioned on a surface of the circuit board away from the first cavity, and the selector switch is positioned next to the stepless adjustment member.

The middle housing is equipped with a support block at a position corresponding to the shaft rod, and the circuit board is provided with a first avoidance opening for avoiding the support block. The inflation pump further includes a position limiting cover and a pressing member.

The position limiting cover is sleeved on an outer side of the roller and cooperates with the support block to limit a position of the roller. The position limiting cover is provided with a second avoidance opening for avoiding the roller.

The pressing member is made of flexible material, and the pressing member is sleeved on an outer side of the position limiting cover. The pressing member is provided with a third avoidance opening for avoiding the position limiting cover. A first position limiting edge is provided on a periphery of the position limiting cover, and a second position limiting edge is provided on a periphery of the pressing member in a protruding manner. The first position limiting edge is positioned between the pressing member and the circuit board, and the second position limiting edge is positioned between the circuit board and the outer cover. The outer cover is provided with a fourth avoidance opening for avoiding the pressing member.

The pressing member is equipped with a first pressing rod at a position corresponding to the selector switch for pressing the selector switch.

Furthermore, the circuit board is also provided with a power button electrically connected to the control module. The power button and the selector switch are arranged around a periphery of the roller. The pressing member is provided with a second pressing rod at a position corresponding to the power button for pressing the power button.

The inflation pump further includes a lighting module for illumination. The circuit board is provided with a lighting switch electrically connected to the control module. The lighting switch and the selector switch are arranged around the periphery of the roller. The pressing member is provided with a third pressing rod at a position corresponding to the lighting switch for pressing the lighting switch.

Furthermore, the position limiting cover is provided with first positioning ends, and the pressing member is provided with second positioning ends. First positioning holes and second positioning holes are defined in the circuit board. The first positioning end is placed inside the first positioning hole, and the second positioning end is placed inside the second positioning hole.

Furthermore, the middle housing includes a first housing and a second housing. The second housing is connected to the first housing to form the first cavity and the second cavity. A top portion of the first cavity is a top opening, and the middle housing further includes a top cover plate arranged at the top opening.

The inflation pump further includes a lighting module for illumination. The lighting module is positioned inside the first cavity, and the lighting module is arranged on the top cover plate. A lighting opening is defined in the top cover plate. The middle housing further includes a lampshade arranged at the lighting opening for transmitting light.

Furthermore, the outer cover includes: a kit with fifth avoidance openings at both ends, a top housing sleeved on a top portion of the middle housing, and a bottom housing sleeved on a bottom portion of the middle housing.

The kit is sleeved on the middle housing and forms the third cavity with the middle housing. The top housing and the bottom housing are respectively positioned at an upper end and a lower end of the kit, and the top housing and the bottom housing cooperate to fix the kit.

The circuit board is equipped with a display, and the outer cover is provided with a display window at a position corresponding to the display. The kit is equipped with a light-transmitting cover plate at a position corresponding to the display window.

The present invention has the following beneficial effects. Compared with the prior art, in the present invention, by configuring the plurality of inflation types with different power ranges within the control module and configuring the selector switch, the user can switch the inflation types to adapt to the inflation of various types of products, thereby effectively improving the product application range of the inflation pump and breaking the limitation of the existing inflation pump that can only inflate one type of product. Furthermore, in this embodiment, by configuring the stepless adjustment member, the user can adjust within the power range of the inflation type through the stepless adjustment member, allowing the control module to increase or decrease the driving power output to the pump body, thereby improving an inflation rate and enhancing the user's experience of using the inflation pump.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
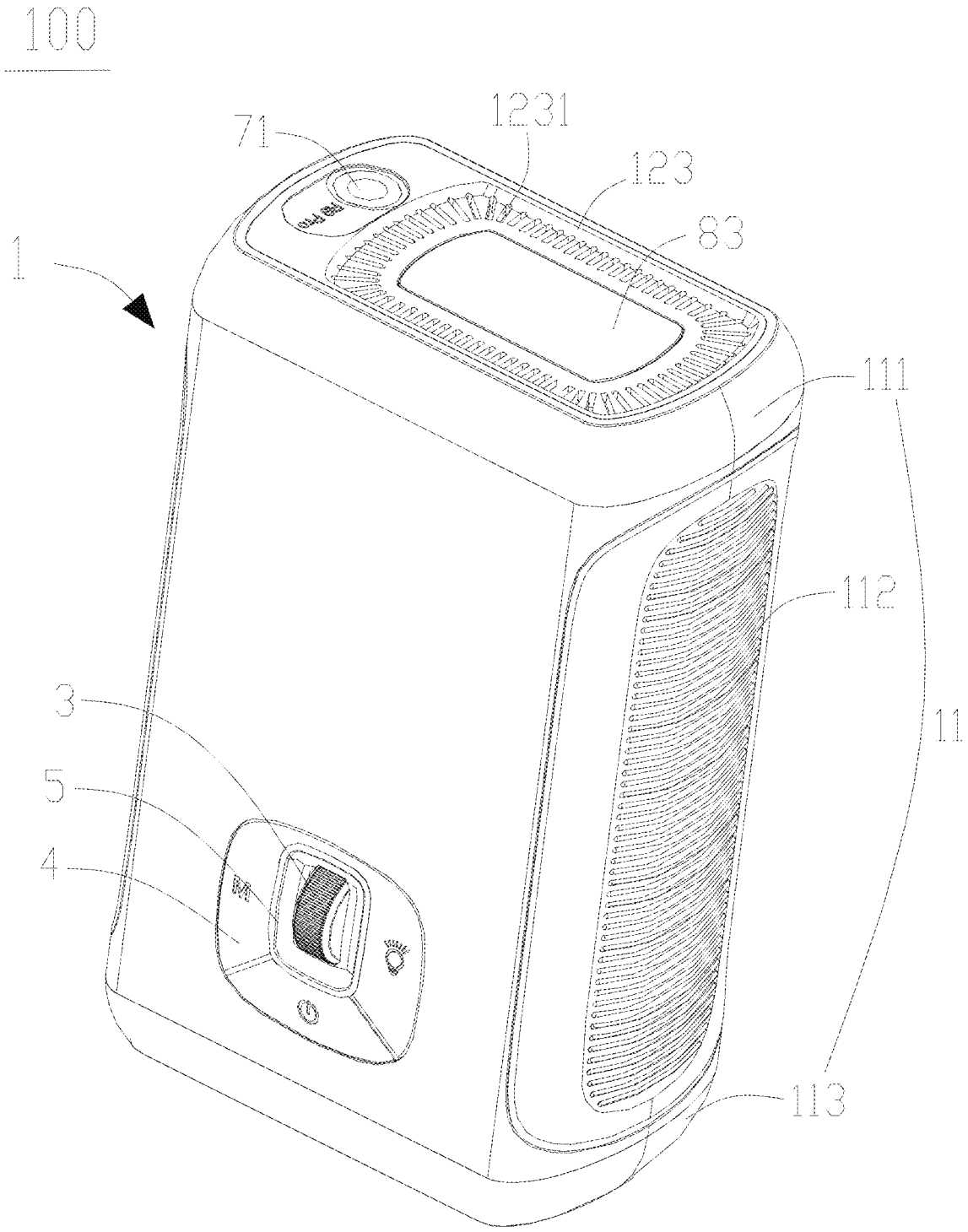
FIG. 1 is a perspective view of the present invention.
Figure 2:
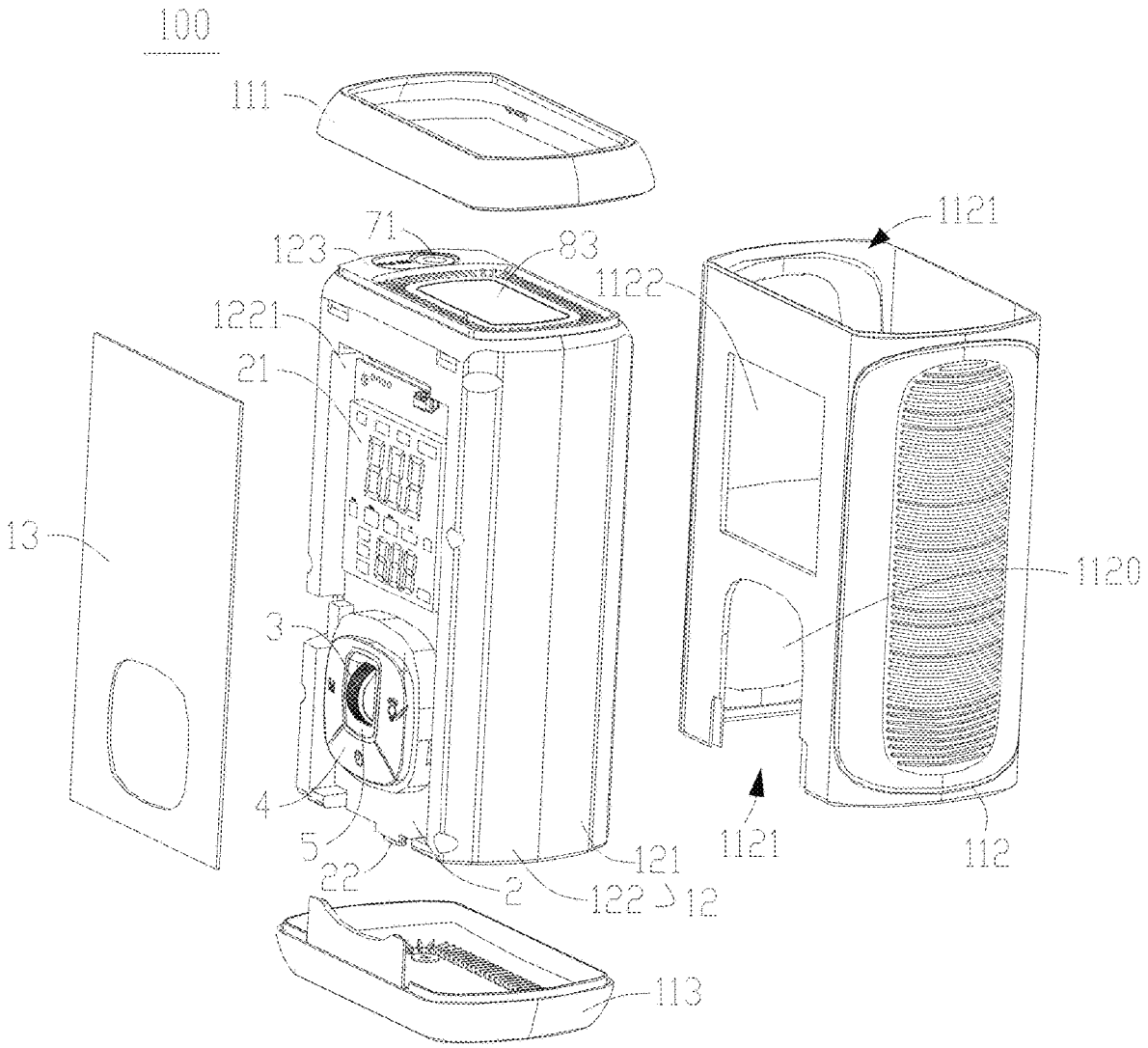
FIG. 2 is a partially exploded view of the present invention.
Figure 3:
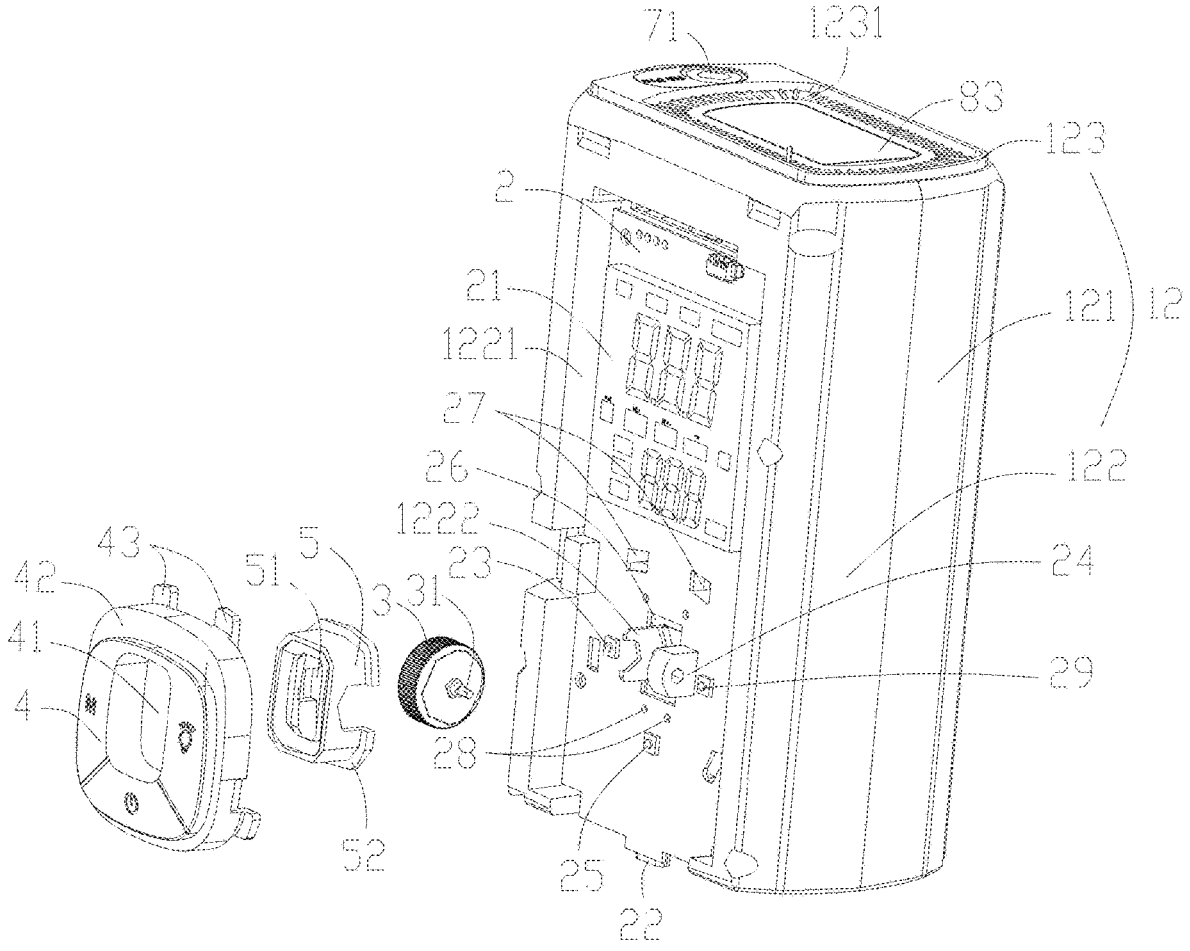
FIG. 3 is a partially exploded view of the present invention with an outer cover removed.
Figure 4:
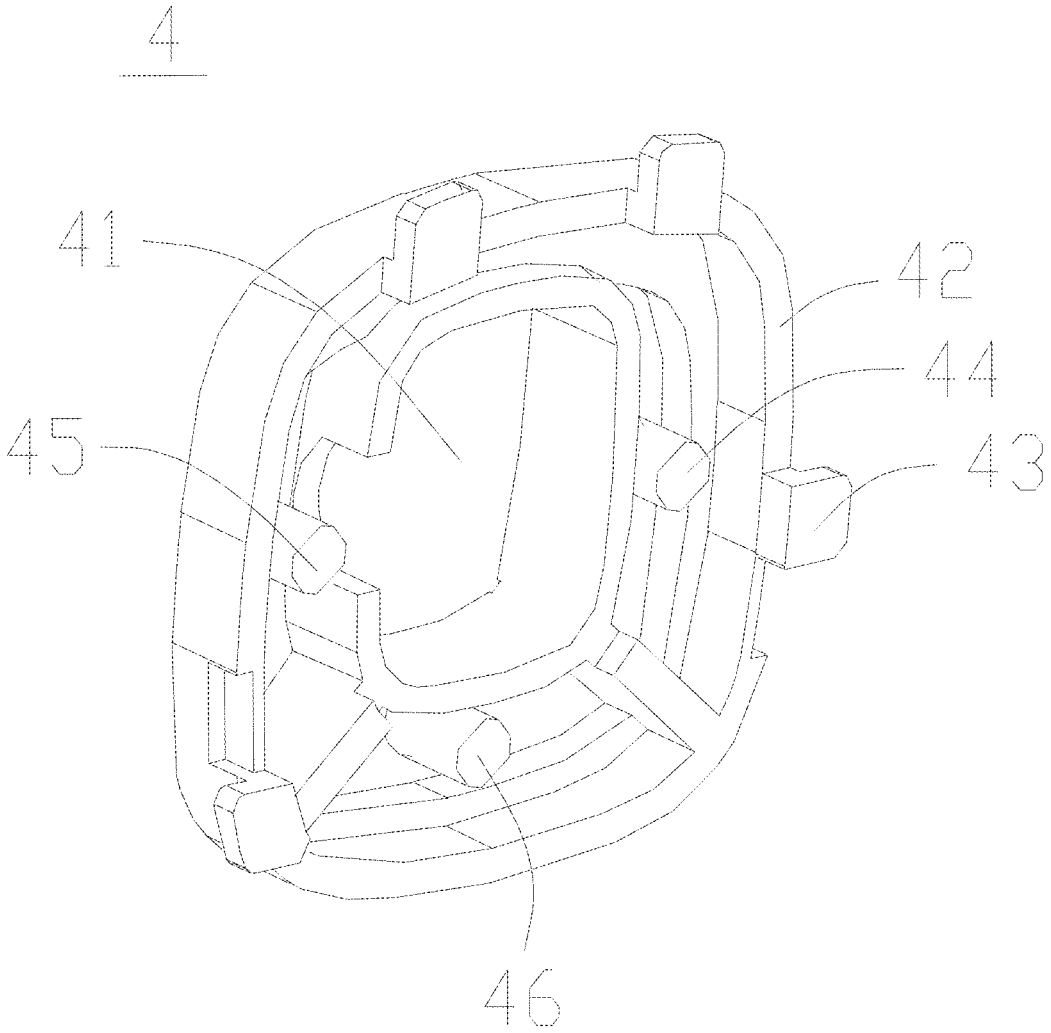
FIG. 4 is a structural diagram of a pressing member of the present invention.
Figure 5:
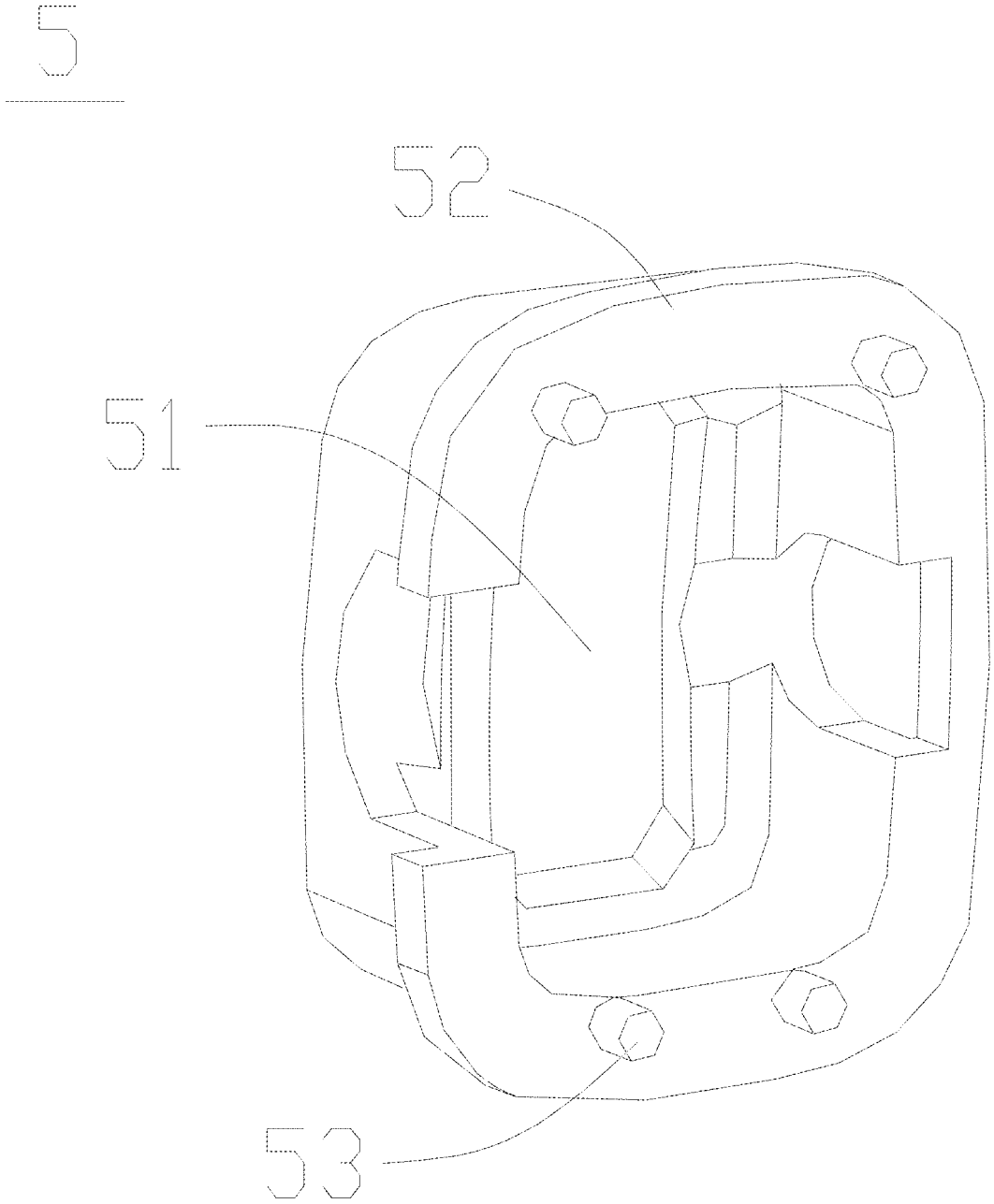
FIG. 5 is a structural diagram of a position limiting cover of the present invention.
Figure 6:
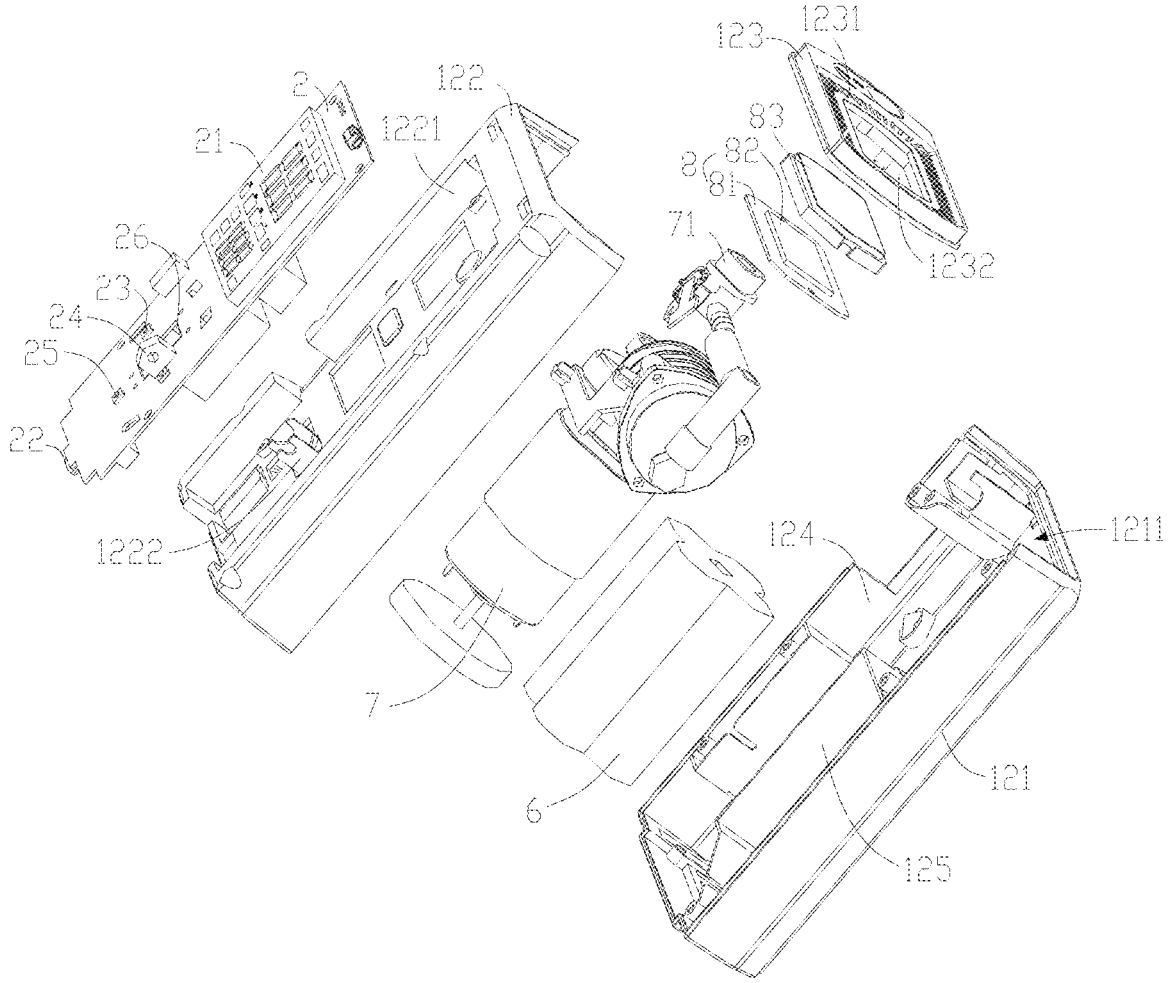
FIG. 6 is an exploded view of the present invention with an outer cover, a position limiting cover, and a pressing member removed.
Figure 7:
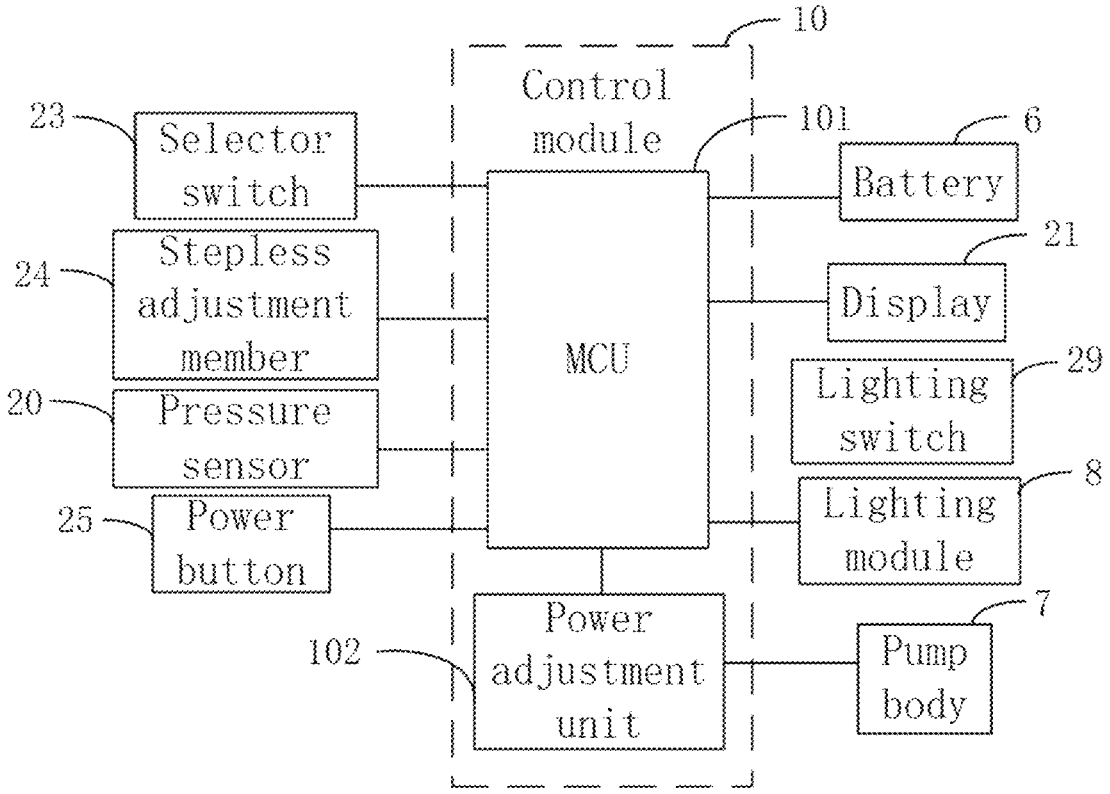
FIG. 7 is a circuit principle block diagram of the present invention.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the features. In the description of embodiments of the application, "a plurality of" means two or more, unless otherwise specifically defined.

FIGS. 1-8 show an inflation pump 100 in an embodiment of the present invention.

The inflation pump 100 includes a main body 1, a control module 10, a pump body 7, a battery 6, a stepless adjustment member 24, and a selector switch 23. The control module 10, the pump body 7, the battery 6, the stepless adjustment member 24, and the selector switch 23 are arranged on the main body 1. The control module 10 is electrically connected to the battery 6, the pump body 7, the stepless adjustment member 24, and the selector switch 23, respectively. A plurality of inflation types with different power ranges for driving the pump body 7 to work are preset within the control module 10. The selector switch 23 is used for user operation and transmitting a switching signal to the control module 10, and the stepless adjustment member 24 is used for user operation and transmitting a stepless adjustment signal to the control module 10. The control module 10 is configured for switching an inflation type according to the switching signal and outputting preset power corresponding to the inflation type to the pump body 7. The control module 10 is also configured for adjusting driving power output to the pump body 7 within a power range of a corresponding inflation type according to the stepless adjustment signal.

In this embodiment, the plurality of inflation types with different power ranges are configured inside the control module 10, and the selector switch 23 is configured for a user to switch inflation types to adapt to inflation of various types of product. Therefore, the product applicability of the inflation pump 100 can be effectively improved, breaking the limitation of an existing inflation pump that can only inflate one type of product. Furthermore, in this embodiment, by configuring the stepless adjustment member 24, the user can adjust within the power range of the inflation type through the stepless adjustment member 24, allowing the control module 10 to increase or decrease the driving power output to the pump body 7, thereby improving an inflation rate and enhancing the user's experience of using the inflation pump 100.

It should be noted that driving the pump body 7 with different powers can allow the pump body 7 to output different air pressures. Based on this, the control module 10 can configure the power range of driving the pump body 7 according to an air pressure range required to be output by the pump body 7.

Specifically, the plurality of inflation types can be inflating basketballs, inflating car tires, inflating bicycle tires, inflating motorcycle tires, custom inflation, etc. An air pressure range for inflating basketballs can be preset as 4-16 PSI, an air pressure range for inflating bicycle tires can be preset as 30-120 PSI, an air pressure range for inflating motorcycle tires can be preset as 26-44 PSI, an air pressure range for inflating car tires can be preset as 26-51 PSI, and an air pressure range for custom inflation can be preset as 3-150 PSI. Correspondingly, the control module 10 configures a corresponding power range according to an inflation type to drive the pump body 7 to work, so that the pump body 7 outputs a corresponding air pressure.

When the control module 10 switches the inflation type to inflating basketballs, and when the stepless adjustment member 24 is utilized to adjust the output air pressure of the pump body 7, an adjustable air pressure range is limited to 4-16 PSI. Based on factory settings, when the control module 10 switches the inflation type to inflating basketballs and the user provides the inflation pump 100 of this embodiment for inflation, a default output air pressure is 8 PSI when the air pressure is not adjusted by the stepless adjustment member 24.

When the control module 10 switches the inflation type to inflating bicycle tires, and when the stepless adjustment member 24 is utilized to adjust the output air pressure of the pump body 7, the adjustable air pressure range is limited to 30-120 PSI. Based on the factory settings, when the control module 10 switches the inflation type to inflating bicycle tires and the user provides the inflation pump 100 of this embodiment for inflation, the default output air pressure is 45 PSI when the air pressure is not adjusted by the stepless adjustment member 24.

When the control module 10 switches the inflation type to inflating motorcycle tires, and when the stepless adjustment member 24 is utilized to adjust the output air pressure of the pump body 7, the adjustable air pressure range is limited to 26-44 PSI. Based on the factory settings, when the control module 10 switches the inflation type to inflating motorcycle tires and the user provides the inflation pump 100 of this embodiment for inflation, the default output air pressure is 35 PSI when the air pressure is not adjusted by the stepless adjustment member 24.

When the control module 10 switches the inflation type to inflating car tires, and when the stepless adjustment member 24 is utilized to adjust the output air pressure of the pump body 7, the adjustable air pressure range is limited to 26-51 PSI. Based on the factory settings, when the control module 10 switches the inflation type to inflating car tires and the user provides the inflation pump 100 of this embodiment for inflation, the default output air pressure is 36 PSI when the air pressure is not adjusted by the stepless adjustment member 24.

When the control module 10 switches the inflation type to custom inflation, and when the stepless adjustment member 24 is utilized to adjust the output air pressure of the pump body 7, the adjustable air pressure range is limited to 3-150 PSI. Based on the factory settings, when the control module 10 switches the inflation type to custom inflation and the user provides the inflation pump 100 of this embodiment for inflation, the default output air pressure is 30 PSI when the air pressure is not adjusted by the stepless adjustment member 24.

Of course, in other embodiments, the pressure range for inflating bicycle tires can also be preset to 20-100 PSI, the pressure range for inflating motorcycle tires can be preset to 20-40 PSI, and the pressure range for inflating car tires can be preset to 20-45 PSI, etc. The air pressure range for inflating bicycle tires, the air pressure range for inflating motorcycle tires, the air pressure range for inflating car tires, and the air pressure range for inflating balls can be customized by manufacturers or in subsequent program upgrades. The air pressures of inflating basketballs, inflating car tires, inflating bicycle tires, inflating motorcycle tires, custom inflation and other inflation types are not limited here.

In one embodiment, the stepless adjustment member 24 can be a digital encoder. Specifically, when a knob of the digital encoder is turned, two changing electrical signals (i.e., stepless adjustment signals) can be output to the control module 10, and the control module 10 adjusts the driving power output to the pump body 7 based on the changing electrical signals.

In one embodiment, the stepless adjustment member 24 can also be a rotary potentiometer, that is, when a knob on the rotary potentiometer is turned, a resistance value of the rotary potentiometer can be adjusted. Based on different resistance values, the rotary potentiometer can feed back different voltage signals (i.e. stepless adjustment signals) to the control module 10, and the control module 10 adjusts the driving power output to the pump body 7 within a power range according to the voltage signal.

Specifically, when the stepless adjustment member 24 can be a digital encoder or a rotary potentiometer, the main body 1 is equipped with a roller 3. The roller 3 is connected to the knob on the digital encoder or the rotary potentiometer. The stepless adjustment member 24 is configured for outputting a stepless adjustment signal to the control module 10 when the user rotates the roller 3. Based on this, the control module 10 adjusts the driving power output to the pump body 7. By using the roller 3, it is convenient for the user to operate.

In one embodiment, the stepless adjustment member 24 can also be a sliding potentiometer. A sliding member is slidably provided on the main body 1. The sliding member is connected to the sliding potentiometer. When the user slides the sliding member, the sliding potentiometer is configured for outputting the stepless adjustment signal to the control module 10. Specifically, when the user slides the sliding member, a resistance value connected to the control module 10 will be changed. Based on different resistance values, the rotary potentiometer can feed back different voltage signals (i.e. stepless adjustment signals) to the control module 10. The control module 10 adjusts the driving power output to the pump body 7 within the power range according to the voltage signals.

In the above embodiment, the control module 10 includes an MCU 101 and a power adjustment unit 102. The selector switch 23, the stepless adjustment member 24, the battery 6, and the power adjustment unit 102 are all electrically connected to the MCU 101. The power adjustment unit 102 is electrically connected to the pump body 7. The plurality of inflation types are provided in the MCU 101. The MCU 101 is used for receiving the stepless adjustment signal and generating a driving signal corresponding to the stepless adjustment signal. The power adjustment unit 102 is used for receiving the driving signal and adjusting the driving power output to the pump body 7 to achieve the output of driving power corresponding to an inflation type to the pump body 7.

Specifically, the power adjustment unit 102 includes a switch tube 1021. A drain electrode of the switch tube 1021 is electrically connected to a negative electrode of the pump body 7. A source electrode of the switch tube 1021 is grounded. A grid electrode of the switch tube 1021 is electrically connected to the MCU 101. A positive electrode of the battery 6 is electrically connected to a positive electrode of the pump body 7. The switch tube 1021 conducts according to the driving signal output by the MCU 101 and adjusts duty ratio according to the driving signal to regulate the driving power output to the pump body 7. By utilizing the conduction duty cycle of the switch tube 1021, a voltage output to the pump body 7 can be adjusted, thereby achieving the adjustment of the power output to the pump body 7.

Figure 8:
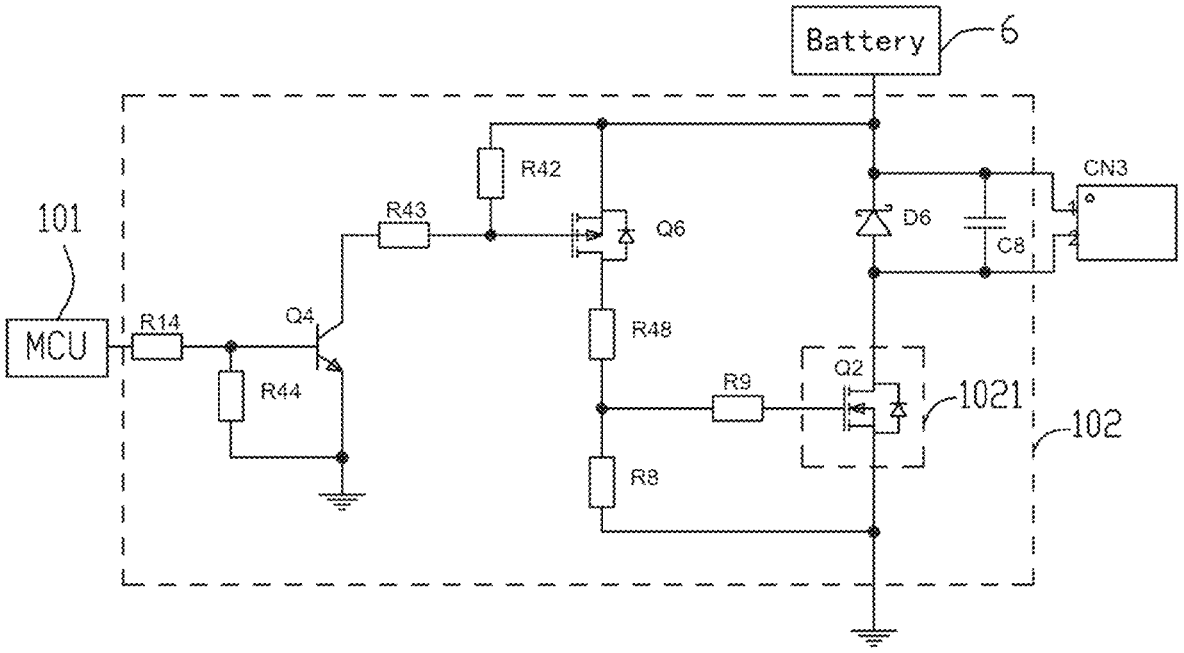
FIG. 8 a circuit diagram in which a power adjustment unit is electrically connected to an MCU and a battery respectively according to the present invention.

Of course, in other embodiments, the power adjustment unit 102 may also include a plurality of switch tubes 1021, resistors, and other components, as shown in FIG. 8, a CN3 interface is used for connecting to the pump body 7.

In one embodiment, the inflation pump 100 further includes a pressure sensor 20 arranged on the main body 1. The pressure sensor 20 is positioned at an output end of the pump body 7. The pressure sensor 20 is electrically connected to the control module 10, that is, the pressure sensor 20 is electrically connected to the MCU 101. The pressure sensor 20 is used for detecting an air pressure output by the main body and feeding back a pressure signal corresponding to the air pressure to the control module 10. The control module 10 adjusts the driving power output to the pump body 7 based on the pressure signal. The pressure sensor 20 is used for detecting the air pressure output by the pump body 7 in real time, and feeding back an electrical signal corresponding to the air pressure to the MCU 101. Based on the electrical signal, the MCU 101 outputs driving power to the pump body 7 to allow the pump body 7 to output air pressure at a constant rate, stabilizing the output air pressure at a value.

In one embodiment, the inflation pump 100 further includes a display 21 arranged on the main body 1. The display 21 is used for at least one of displaying the output air pressure and displaying electrical quantity of the battery 6. Through the display 21, the user can understand the electrical quantity of the battery 6 and the output air pressure, making it convenient for the user to use. Specifically, the display 21 can be a digital display 21 or a display screen, etc.

In one embodiment, the inflation pump 100 further includes a lighting module 8 for illumination. The lighting module 8 is arranged on the main body 1, and the control module 10 is electrically connected to the lighting module 8. By means of the lighting module 8, the inflation pump 100 of this embodiment can have a lighting function, which can be used when needed by the user and improve the practicality of the inflation pump 100 of this embodiment.

Specifically, the lighting module 8 includes a lamp board 81 arranged inside the main body 1 and a lighting lamp 82 arranged on the lamp board 81. The lamp board 81 is electrically connected to the control module 10, and the lamp board 81 is positioned at a top portion of the pump body 7. A top portion of the main body 1 is provided with a lighting opening 1232 at a position corresponding to the lighting lamp 82. The main body 1 is provided with a lampshade 83 at a position corresponding to the lighting opening 1232. The top portion of the main body 1 is provided with an air outlet interface 71 for connecting to an inflation tube. The air outlet interface 71 is in communication with an air outlet of the pump body 7. The air outlet interface 71 is positioned on one side of the lighting opening 1232 to reasonably configure the structure of the inflation pump 100 in this embodiment. When the pump body 7 outputs air pressure through the air outlet interface 71, the lighting module 8 will not be damaged.

In one embodiment, the main body 1 is provided with a plurality of air inlet holes 1231 on a periphery of the lampshade 83. The air outlet interface 71 is positioned on one side of the air inlet holes 1231 away from the lighting opening 1232. By using the air inlet holes 1231, air can enter the pump body 7 from the outside and be processed to form gas with a certain air pressure, and then the gas is output through the air outlet interface 71. Moreover, by using the air inlet hole 1231, the lamp board 81 can also dissipate heat.

In the above embodiment, the inflation pump 100 further includes a lighting switch 29, and the control module 10 drives the lighting module 8 to illuminate when the lighting switch 29 is operated, so that the user can control the lighting to be turned on for use through the lighting switch 29 when lighting is needed.

In one embodiment, the main body 1 is equipped with a charging interface 22 for connecting to an external power supply. The charging interface 22 is electrically connected to the control module 10. By connecting the charging interface 22 to the external power supply, the battery 6 can be charged through the control module 10.

Specifically, the control module 10 also includes a charging and discharging circuit. The charging and discharging circuit is electrically connected to the charging interface 22, the battery 6, the MCU 101, and the power adjustment unit 102. After the charging interface 22 is connected to the power supply, the battery 6 is charged through the charging and discharging circuit. In this embodiment, when the charging pump 100 is used, the battery 6 can supply power to the MCU 101 and the power adjustment unit 102 through the charging and discharging circuit. In an embodiment with a lighting module 8, the charging and discharging circuit is also electrically connected to the lighting module 8 to supply power to the the lighting module 8. Alternatively, in a state where the MCU 101 can directly drive the lighting module 8, the charging and discharging circuit may not be electrically connected to the lighting module 8.

In the above embodiment, the inflation pump 100 further includes a circuit board 2. The control module 10, the stepless adjustment member 24, and the selector switch 23 are all integrated on the circuit board 2. The circuit board 2 is provided inside the main body 1 to simplify parts of the inflation pump 100 in this embodiment and facilitate the production and manufacturing of the inflation pump 100.

In one embodiment, the main body 1 includes a middle housing 12 and an outer cover 11. A first cavity 124 and a second cavity 125 are defined in the middle housing. The pump body 7 is arranged in the first cavity 124, and the battery 6 is arranged in the second cavity 125. The outer cover 11 is sleeved on an outer side of the middle housing 12. A third cavity 1221 is formed between the outer cover 11 and the middle housing 12. The circuit board 2 is arranged in the third cavity 1221. The third cavity 1221 is respectively connected to the first cavity 124 and the second cavity 125, so that the control module 10 is electrically connected to the pump body 7 and the battery 6. Moreover, the first cavity 124, the second cavity 125, and the third chamber 1221 are respectively equipped with the pump body 7, the battery 6, and the circuit board 2, so that the pump body 7, the battery 6, and the circuit board 2 can be installed on the main body 1, and the compactness of the structure of the inflation pump 100 in this embodiment can also be improved.

In an embodiment where the stepless adjustment member 24 is a digital encoder and is connected to the roller 3, shaft rods 31 are provided on both sides of the roller 3, and one of the shaft rods 31 is connected to the digital encoder. The stepless adjustment member 24 and the selector switch 23 are both positioned on a surface of the circuit board 2 away from the first cavity 124, and the selector switch 23 is positioned next to the stepless adjustment member 24. By disposing the stepless adjustment member 24 and the selector switch 23 together, it is easy for the user to operate and use.

The middle housing 12 is equipped with a support block 1222 at a position corresponding to the shaft rod 31, and the circuit board 2 is provided with a first avoidance opening 26 for avoiding the support block 1222. The inflation pump 100 further includes a position limiting cover 5 and a pressing member 4. The position limiting cover 5 is sleeved on an outer side of the roller 3 and cooperates with the support block 1222 to limit a position of the roller 3. The position limiting cover 5 is provided with a second avoidance opening 51 for avoiding the roller 3. By using the first avoidance opening 26, the support block 1222 can pass through the circuit board 2, so that the support block 1222 can cooperate with the position limiting cover 5 to achieve position limiting of the shaft rods 31 on both sides of the roller 3, thereby limiting the position of the roller 3. Moreover, by using the second avoidance opening 51, the roller 3 can be exposed for user operation.

The pressing member 4 is made of flexible material, and the pressing member 4 is sleeved on an outer side of the position limiting cover 5. The pressing member 4 is provided with a third avoidance opening 41 for avoiding the position limiting cover 5, so as to expose the roller 3. A first position limiting edge 52 is provided on a periphery of the position limiting cover 5, and a second position limiting edge 42 is provided on a periphery of the pressing member 4 in a protruding manner. The first position limiting edge 52 is positioned between the pressing member 4 and the circuit board 2, and the second position limiting edge 42 is positioned between the circuit board 2 and the outer cover 11 to achieve the fixation of the position limiting cover 5 and the pressing member 4.

The pressing member 4 is equipped with a first pressing rod 44 at a position corresponding to the selector switch 23 for pressing the selector switch 23. The outer cover 11 is provided with a fourth avoidance opening 1120 for avoiding the pressing member 4, so that the user can press the pressing member 4. Moreover, when the user presses the pressing member 4 at the first pressing rod 44, by using the first pressing rod 44, the selector switch 23 can be pressed, so that the selector switch 23 can be made conductive, that is, the selector switch 23 feeds back an electrical signal (i.e. switching signal) to the control module 10, and the control module 10 switches the inflation type according to the signal.

In one embodiment, the position limiting cover 5 is provided with first positioning ends 53, and the pressing member 4 is provided with second positioning ends 43. First positioning holes 28 and second positioning holes 27 are defined in the circuit board 2. The first positioning end 53 is placed inside the first positioning hole 28, and the second positioning end 43 is placed inside the second positioning hole 27, thereby improving the stability of the installation of the position limiting cover 5 and the pressing member 4.

In one embodiment, the circuit board 2 is also provided with a power button 25 electrically connected to the control module 10. The power button 25 and the selector switch 23 are arranged around a periphery of the roller 3. The pressing member 4 is provided with a second pressing rod 46 at a position corresponding to the power button 25 for pressing the power button 25. When the user presses the pressing member 4 at the second pressing rod 46, by using the second pressing rod 46, the power button 25 can be pressed, so that the power button 25 can be made conductive. That is, the power button 25 feeds back an electrical signal to the control module 10, and the control module 10 activates or inactivates according to the signal, so that the user can operate the selector switch 23 and the stepless adjustment member 24 later.

In an embodiment with a lighting module 8, the inflation pump 100 further includes the lighting module 8 for illumination. The circuit board 2 is provided with a lighting switch 29 electrically connected to the control module 10. The lighting switch 29 and the selector switch 23 are arranged around the periphery of the roller 3. The pressing member 4 is provided with a third pressing rod 45 at a position corresponding to the lighting switch 29 for pressing the lighting switch 29. When the user presses the pressing member 4 at the third pressing rod 45, by using the third pressing rod 45, the lighting switch 29 can be pressed, so that the lighting switch 29 can be conductive, that is, the lighting switch 29 feeds back an electrical signal to the control module 10, and the control module 10 drives the lighting module 8 to illuminate or turn off the lighting module 8 according to the signal.

In one embodiment, the middle housing 12 includes a first housing 121 and a second housing 122. The second housing 122 is connected to the first housing 121 to form the first cavity 124 and the second cavity 125. The middle housing 12 is formed by connecting the first housing 121 to the second housing 122, which facilitates the manufacturing and production of the middle housing 12. Moreover, the first housing 121 and the second housing 122 can be fixed by screws, buckles, glue, and other methods.

A top portion of the first cavity 124 is a top opening 1211, and the middle housing 12 further includes a top cover plate 123 arranged at the top opening 1211. The lighting module 8 is positioned inside the first cavity 124, and the lamp board 81 of the lighting module 8 is arranged on the top cover plate 123. A lighting opening 1232 is defined in the top cover plate 123, and the lampshade 83 is arranged at the lighting opening 1232 of the top cover plate 123 to allow the light of the lighting module 8 to pass through. The lampshade 83 is limited and fixed by the lamp board 81 and the top cover plate 123.

In one embodiment, the outer cover 11 includes: a kit 112 with fifth avoidance openings 1121 at both ends, a top housing 111 sleeved on a top portion of the middle housing 12, and a bottom housing 113 sleeved on a bottom portion of the middle housing 12. By using the kit 112 with the fifth avoidance openings 1121 on both ends, the kit 112 can be sleeved on a middle position of the middle housing 12. The kit 112 is sleeved on the middle housing 12 and forms the third cavity 1221 with the middle housing 12. The top housing 111 and the bottom housing 113 are respectively positioned at an upper end and a lower end of the kit 112, and the top housing 111 and the bottom housing 113 cooperate to fix the kit 112 to prevent the kit 112 from moving. Moreover, the top housing 111 is sleeved on the middle housing 12, which can also press the top cover plate 123 tightly. Specifically, both the top housing 111 and the bottom housing 113 can be fixed to the middle housing 12 using screws or buckles, etc.

The circuit board 2 is equipped with a display 21, and the outer cover 11 is provided with a display window 1122 at a position corresponding to the display 21. The kit 112 is equipped with a light-transmitting cover plate 13 at a position corresponding to the display window 1122, and the light-transmitting cover plate 13 can be used for protecting the display 21.

The above description only describes embodiments of the present disclosure, and is not intended to limit the present disclosure; various modifications and changes can be made to the present disclosure. Any modifications, equivalent substitutions, and improvements made within the spirit and scope of the present disclosure are intended to be included within the scope of the present disclosure.

What is claimed is:

1. An inflation pump, comprising:

a main body;

a control module;

a pump body;

a battery;

a stepless adjustment member; and a selector switch;

wherein the control module, the pump body, the battery, the stepless adjustment member, and the selector switch are arranged on the main body; and the control module is electrically connected to the battery, the pump body, the stepless adjustment member, and the selector switch, respectively;

a plurality of inflation types with different power ranges for driving the pump body to work are preset within the control module; the selector switch is used for user operation and transmitting a switching signal to the control module; and the stepless adjustment member is used for user operation and transmitting a stepless adjustment signal to the control module;

the control module is configured for switching an inflation type according to the switching signal and outputting preset power corresponding to the inflation type to the pump body; and the control module is also configured for adjusting driving power output to the pump body within a power range of a corresponding inflation type according to the stepless adjustment signal;

wherein the control module comprises a microcontroller unit (MCU) and a power adjustment unit; the selector switch, the stepless adjustment member, the battery, and the power adjustment unit are all electrically connected to the MCU; the power adjustment unit is electrically connected to the pump body; the plurality of inflation types are provided in the MCU; the MCU is used for receiving the stepless adjustment signal and generating a driving signal corresponding to the stepless adjustment signal; and the power adjustment unit is used for receiving the driving signal and adjusting driving power output to the pump body;

wherein the power adjustment unit comprises a switch tube; a drain electrode of the switch tube is electrically connected to a negative electrode of the pump body; a source electrode of the switch tube is grounded; a grid electrode of the switch tube is electrically connected to the MCU; a positive electrode of the battery is electrically connected to a positive electrode of the pump body; and the switch tube conducts according to the driving signal output by the MCU and adjusts duty ratio according to the driving signal to regulate the driving power output to the pump body.

2. The inflation pump according to claim 1, wherein the stepless adjustment member is a digital encoder or a rotary potentiometer.

3. The inflation pump according to claim 2, wherein the main body is equipped with a roller; the roller is connected to the stepless adjustment member; and the stepless adjustment member is configured for outputting a stepless adjustment signal to the control module when a user rotates the roller.

4. The inflation pump according to claim 1, wherein the stepless adjustment member is a sliding potentiometer; and the sliding potentiometer is configured for outputting the stepless adjustment signal to the control module when the user operates.

5. The inflation pump according to claim 1, wherein the inflation pump further comprises a pressure sensor arranged on the main body; the pressure sensor is positioned at an output end of the pump body; the pressure sensor is electrically connected to the control module; the pressure sensor is used for detecting an air pressure output by the main body and feeding back a pressure signal corresponding to the air pressure to the control module; and the control module adjusts the driving power output to the pump body based on the pressure signal.

6. The inflation pump according to claim 5, further comprising a display arranged on the main body, wherein the display is used for at least one of displaying the output air pressure and displaying electrical quantity of the battery.

7. The inflation pump according to claim 1, further comprising a lighting module for illumination, wherein the lighting module is arranged on the main body; and the control module is electrically connected to the lighting module.

8. The inflation pump according to claim 1, wherein the main body is equipped with a charging interface for connecting to an external power supply; and the charging interface is electrically connected to the control module.

9. The inflation pump according to claim 1, further comprising a circuit board, wherein the control module, the stepless adjustment member, and the selector switch are all integrated on the circuit board; and the circuit board is provided inside the main body.

10. An inflation pump, comprising:

a main body;

a control module;

a pump body;

a battery;

a stepless adjustment member; and a selector switch;

wherein the control module, the pump body, the battery, the stepless adjustment member, and the selector switch are arranged on the main body; and the control module is electrically connected to the battery, the pump body, the stepless adjustment member, and the selector switch, respectively;

a plurality of inflation types with different power ranges for driving the pump body to work are preset within the control module; the selector switch is used for user operation and transmitting a switching signal to the control module; and the stepless adjustment member is used for user operation and transmitting a stepless adjustment signal to the control module;

the control module is configured for switching an inflation type according to the switching signal and outputting preset power corresponding to the inflation type to the pump body; and the control module is also configured for adjusting driving power output to the pump body within a power range of a corresponding inflation type according to the stepless adjustment signal;

the inflation pump further comprising a lighting module for illumination, wherein the lighting module is arranged on the main body; and the control module is electrically connected to the lighting module;

wherein the lighting module comprises a lamp board arranged inside the main body and a lighting lamp arranged on the lamp board; the lamp board is electrically connected to the control module; the lamp board is positioned at a top portion of the pump body; a top portion of the main body is provided with a lighting opening at a position corresponding to the lighting lamp; the main body is provided with a lampshade at a position corresponding to the lighting opening; the top portion of the main body is provided with an air outlet interface for connecting to an inflation tube; the air outlet interface is in communication with an air outlet of the pump body; and the air outlet interface is positioned on one side of the lighting opening.

11. The inflation pump according to claim 10, wherein the main body is provided with a plurality of air inlet holes on a periphery of the lampshade; and the air outlet interface is positioned on one side of the air inlet holes away from the lighting opening.

12. The inflation pump according to claim 10, further comprising a lighting switch, wherein the control module drives the lighting module to illuminate when the lighting switch is operated.

13. An inflation pump, comprising:

a main body;

a control module;

a pump body;

a battery;

a stepless adjustment member; and a selector switch;

wherein the control module, the pump body, the battery, the stepless adjustment member, and the selector switch are arranged on the main body; and the control module is electrically connected to the battery, the pump body, the stepless adjustment member, and the selector switch, respectively;

a plurality of inflation types with different power ranges for driving the pump body to work are preset within the control module; the selector switch is used for user operation and transmitting a switching signal to the control module; and the stepless adjustment member is used for user operation and transmitting a stepless adjustment signal to the control module;

the control module is configured for switching an inflation type according to the switching signal and outputting preset power corresponding to the inflation type to the pump body; and the control module is also configured for adjusting driving power output to the pump body within a power range of a corresponding inflation type according to the stepless adjustment signal;

the inflation pump further comprising a circuit board, wherein the control module, the stepless adjustment member, and the selector switch are all integrated on the circuit board; and the circuit board is provided inside the main body;

wherein the main body comprises a middle housing and an outer cover; a first cavity and a second cavity are defined in the middle housing; the pump body is arranged in the first cavity; the battery is arranged in the second cavity; the outer cover is sleeved on an outer side of the middle housing; a third cavity is formed between the outer cover and the middle housing; the circuit board is arranged in the third cavity; and the third cavity is respectively connected to the first cavity and the second cavity.

14. The inflation pump according to claim 13, further comprising a roller, wherein the stepless adjustment member is a digital encoder; shaft rods are provided on both sides of the roller; one of the shaft rods is connected to the digital encoder; the stepless adjustment member and the selector switch are both positioned on a surface of the circuit board away from the first cavity; and the selector switch is positioned next to the stepless adjustment member;

the middle housing is equipped with a support block at a position corresponding to the shaft rod; the circuit board is provided with a first avoidance opening for avoiding the support block; and the inflation pump further comprises a position limiting cover and a pressing member;

the position limiting cover is sleeved on an outer side of the roller and cooperates with the support block to limit a position of the roller; and the position limiting cover is provided with a second avoidance opening for avoiding the roller;

the pressing member is made of flexible material; the pressing member is sleeved on an outer side of the position limiting cover; the pressing member is provided with a third avoidance opening for avoiding the position limiting cover; a first position limiting edge is provided on a periphery of the position limiting cover; a second position limiting edge is provided on a periphery of the pressing member in a protruding manner; the first position limiting edge is positioned between the pressing member and the circuit board; the second position limiting edge is positioned between the circuit board and the outer cover; and the outer cover is provided with a fourth avoidance opening for avoiding the pressing member;

the pressing member is equipped with a first pressing rod at a position corresponding to the selector switch for pressing the selector switch.

15. The inflation pump according to claim 14, wherein the circuit board is also provided with a power button electrically connected to the control module; the power button and the selector switch are arranged around a periphery of the roller; and the pressing member is provided with a second pressing rod at a position corresponding to the power button for pressing the power button;

the inflation pump further comprises a lighting module for illumination; the circuit board is provided with a lighting switch electrically connected to the control module; the lighting switch and the selector switch are arranged around the periphery of the roller; and the pressing member is provided with a third pressing rod at a position corresponding to the lighting switch for pressing the lighting switch.

16. The inflation pump according to claim 14, wherein the position limiting cover is provided with first positioning ends; the pressing member is provided with second positioning ends; first positioning holes and second positioning holes are defined in the circuit board; the first positioning end is placed inside the first positioning hole; and the second positioning end is placed inside the second positioning hole.

17. The inflation pump according to claim 13, wherein the middle housing comprises a first housing and a second housing; the second housing is connected to the first housing to form the first cavity and the second cavity; a top portion of the first cavity is a top opening; and the middle housing further comprises a top cover plate arranged at the top opening;

the inflation pump further comprises a lighting module for illumination; the lighting module is positioned inside the first cavity; the lighting module is arranged on the top cover plate; a lighting opening is defined in the top cover plate; and the middle housing further comprises a lampshade arranged at the lighting opening for transmitting light.

18. The inflation pump according to claim 13, wherein the outer cover comprises:

a kit with fifth avoidance openings at both ends;

a top housing sleeved on a top portion of the middle housing; and a bottom housing sleeved on a bottom portion of the middle housing;

wherein the kit is sleeved on the middle housing and forms the third cavity with the middle housing; the top housing and the bottom housing are respectively positioned at an upper end and a lower end of the kit; and the top housing and the bottom housing cooperate to fix the kit;

the circuit board is equipped with a display; the outer cover is provided with a display window at a position corresponding to the display; and the kit is equipped with a light-transmitting cover plate at a position corresponding to the display window.

* * * * *